US006881912B2

(12) United States Patent
Kobayashi et al.

(10) Patent No.: US 6,881,912 B2
(45) Date of Patent: Apr. 19, 2005

(54) DOOR OPEN/CLOSE OPERATING DEVICE

(75) Inventors: Norikazu Kobayashi, Chita (JP); Koichi Hirota, Takahama (JP); Koji Aoki, Nagoya (JP); Hidetoshi Kadoya, Kariya (JP); Kazuyoshi Mori, Chita (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/650,695

(22) Filed: Aug. 29, 2003

(65) Prior Publication Data

US 2004/0058563 A1 Mar. 25, 2004

(30) Foreign Application Priority Data

Aug. 30, 2002 (JP) ..... 2002-254905

(51) Int. Cl.[7] ..... H01H 3/16
(52) U.S. Cl. ..... 200/61.62; 200/332.1
(58) Field of Search ..... 200/61.62, 330, 200/331, 332.1

(56) References Cited

U.S. PATENT DOCUMENTS 5,535,607 A * 7/1996 Dzurko et al. ..... 70/237
6,696,652 B1 * 2/2004 Spies ..... 200/61.62

FOREIGN PATENT DOCUMENTS

JP 9-21260 A 1/1997
JP 2000-64685 A 2/2000

* cited by examiner

*Primary Examiner*—Elvin Enad
*Assistant Examiner*—Lisa Klaus
(74) *Attorney, Agent, or Firm*—Burns, Doane, Swecker & Mathis, L.L.P.

(57) ABSTRACT

A door open/close operating device includes an operating switch, a control device, an actuator, an output member and an auxiliary power source, and these components are integrally formed. A purpose of the invention is providing the door open/close operating device for enhancing flexibility of assembling the door open/close operating device to the vehicle's door and reducing a man-hour for assembling.

15 Claims, 7 Drawing Sheets

DOOR OPEN/CLOSE OPERATING DEVICE

The present application is based on and claims priority under 35 U.S.C § 119 with respect to Japanese Patent application NO. 2002-254905 filed on Aug. 30, 2002, the entire content of which is incorporated herein by reference.

FIELD OF THE INVENTION

This invention generally relates to a door open/close operating device which provided with a sliding door for an open-close operation.

BACKGROUND OF THE INVENTION

Conventionally, such door open/close operating device is disclosed, for example, in a Japanese Patent Laid-Open Publication No. 9-21260. According to the above Japanese Patent Application Publication, the known sliding door system for a vehicle includes two door locks for supporting a fully closed door, a door lock for supporting a fully opened door, a lock/unlock mechanism including a remote controller and a door handle to lock/unlock the door from inside and outside of the vehicle.

A reaction force of the door is set to be high in the known slide door system because the door and a door seal area are large, and plural door locks are provided at the door. So that a larger operating force is needed for the open/close operation, and the open/close operation becomes awkward for users. In addition, the number of components becomes large, so that flexibility for assembling the components to the door is reduced, and the assembling performance to the door becomes poor.

SUMMARY OF THE INVENTION

A door open/close operating device includes an operating switch, a control device, an actuator, an output member and an auxiliary power source, and these components are integrally formed. A purpose of the invention is providing the door open/close operating device for enhancing flexibility for assembling the door open/close operating device to the vehicle's door and reducing a man-hour for assembling.

BRIEF DESCRIPTION OF THE DRAWINGS

The foregoing and additional features and characteristics of the present invention will become more apparent from the following detailed description considered with reference to the accompanying drawing figures in which like reference numerals designate like elements and wherein.

DETAILED DESCRIPTION OF THE PRESENT INVENTION

Referring now to an embodiment of the door open/close operating device of the present invention with reference to the attached drawings, FIG. 1 through FIG. 10.

Figure 7:
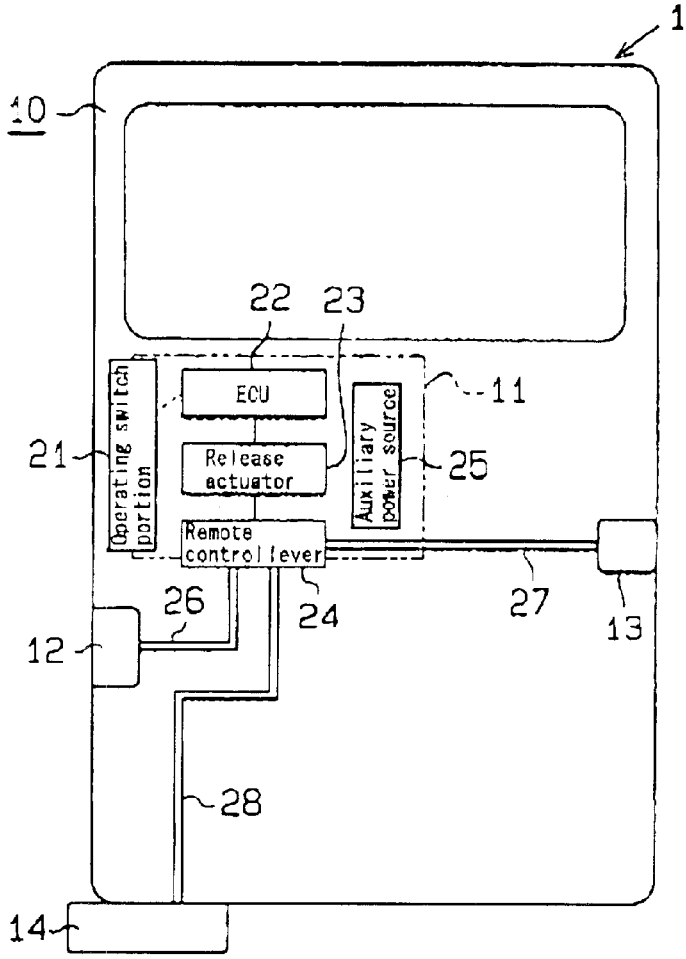
FIG. 7 illustrates a pattern diagram of the embodiment of the current invention.

FIG. 7 illustrates a pattern diagram of a slide door system of a vehicle according to the embodiment of the current invention. As shown in FIG. 7, a slide door system 1 includes a slide door 10, a door open/close operating device 11 and a door open/close member including a front lock 12, a rear lock 13 and a fully/half open stopper 14.

The slide door 10 is opened or closed sliding the door in cross direction of the vehicle at a door opening on the side of the vehicle. The door open/close operating device 11 is assembled at a predetermined position of the vehicle.

The door open/close operating device 11 is integrally provided with an operating switch portion 21, an ECU 22 (electronic control unit) as a control device, a release actuator 23 as an actuator, a remote control lever 24 as an output member and an auxiliary power source 25.

The operating switch portion 21 is provided barely inside the vehicle, which includes after mentioned various types of switches for the door open/close operation. The ECU 22 is comprised of a digital computer and mounts various types of electric circuits. The ECU 22 detects operations of these switches and drives the release actuator 23 according to the relevant operations. As described later, each switch of the operating switch portion 21 is a noncontact switch and detects the switch operations (movements) converting into electric signals without a harness.

The release actuator 23 includes, for example, an electric motor with speed reducer, and the remote control lever 24 is connected to an output axis 54 of the release actuator 23. The remote control lever 24 is connected to the door open/close members including the front lock 12, the rear lock 13 and the fully/half open stopper 14 by connecting cables 26, 27 and 28. The remote control lever 24 transmits a drive force to the door open/close member including the front lock 12, the rear lock 13 and the fully/half open stopper 14 through the connecting cables 26, 27 and 28 and unlocks the door open/close member during the release actuator 23 is driven by the ECU 22.

Figure 8:
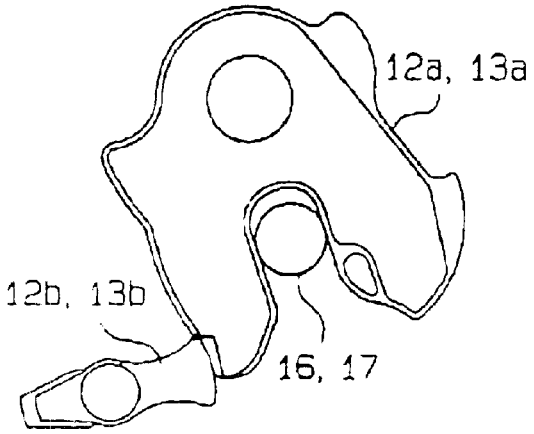
FIG. 8 illustrates a diagram which indicates a front lock and a rear lock.

As shown in FIG. 8, the front lock 12 includes a latch mechanism comprising a latch 12*a* and a pole 12*b*. The front lock 12 locks the front portion of the slide door 10 engaging with an engaging member 16 (striker) which is provided at the vehicle's body when the slide door 10 is in half-latch condition. In other words, when the slide door 10 is closed, the latch 12*a* rotates and engages with the engaging member 16. The latch 12*a* stops its rotation engaging with the pole 12*b*. In this way, the front portion of the slide door 10 is locked. When the pole 12*b* moves, the latch 12*a* disengages with the pole 12*b* and rotates in the other direction by a restitution force of the elastic member's and disengages with the engaging member 16. In this way, the slide door 10 is unlocked. Thus, the connecting cable 26 is connected to the pole 12*b* of the latch mechanism for transmitting the unlock operation of the front lock 12.

The rear lock 13 also includes the latch mechanism comprising a latch 13*a* and a pole 13*b* and locks the rear portion of the slide door 10 according to above steps engaging with an engaging member 17 (striker) which is provided at the vehicle's body when the slide door 10 is in half-shut condition. Thus, the connecting cable 27 is connected to the pole 13*b* of the latch mechanism for transmitting the unlock operation of the rear lock 13.

The fully/half open stopper 14 also includes a latch mechanism comprising a latch and a pole (not shown) and controls the slide movement of the slide door 10 being in full or half opened condition engaging with an engaging member (e.g. stopper) which is assembled to the vehicle's body at predetermined position on the rail for the slide movement of the slide door 10. In other word, the latch rotates interferingly with the engaging member when the slide door 10 is opened. The latch stops its rotation when it engages with the pole. In this way, the slide movement of the slide door 10 becomes being locked. Then the pole moves, and the latch disengages with the pole and rotates in the other direction for disengaging with the engaging member. In this way, the slide door 10 becomes being unlocked. Thus, the connecting cable 28 is connected to the pole of the latch mechanism for transmitting the lock/unlock operation of the fully/half open stopper 14.

Figure 1:
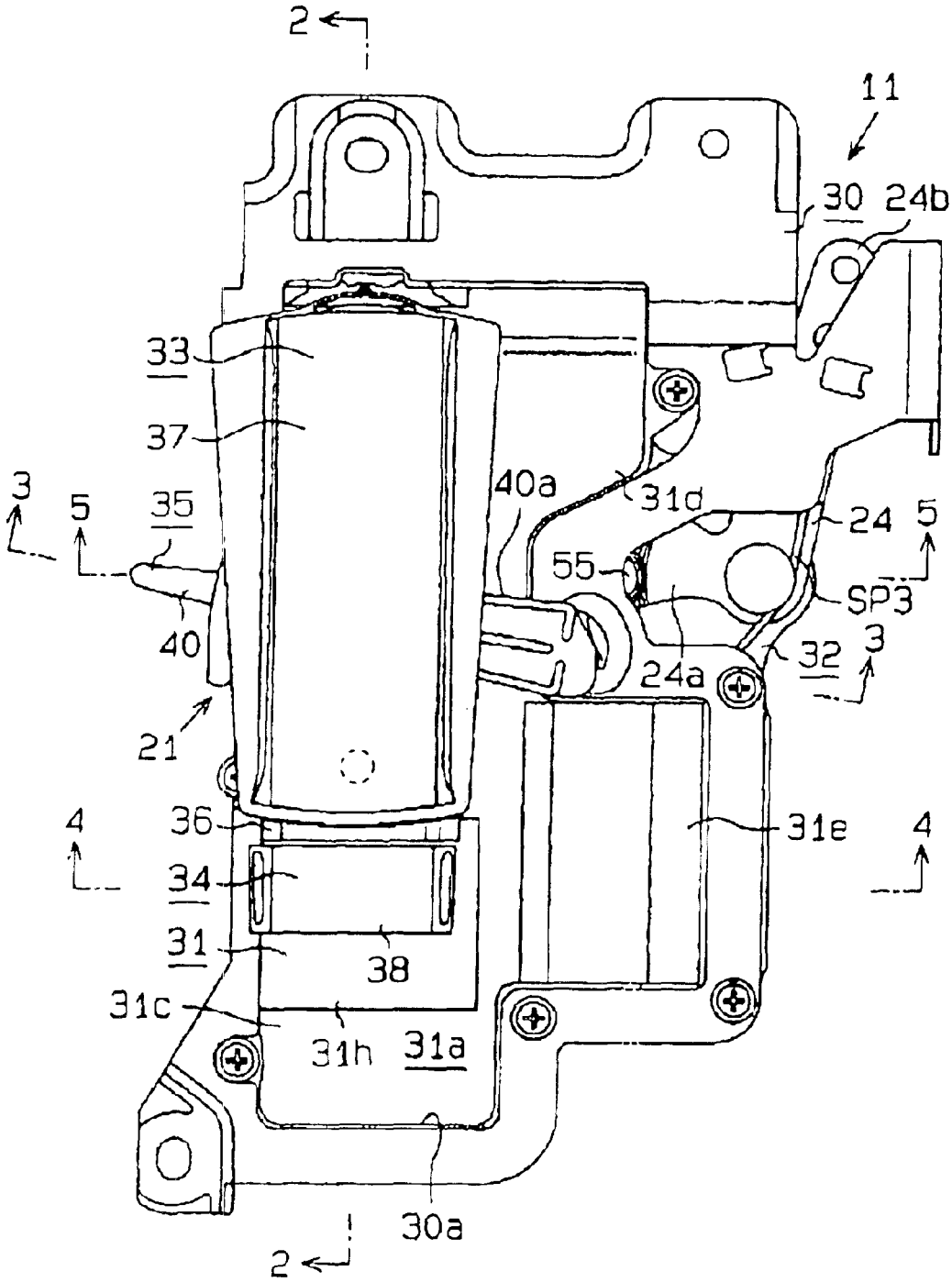
FIG. 1 illustrates a front view diagram of an embodiment of a current invention.

The door open/close operating device 11 is explained in detail with reference to the attached drawings, FIG. 1 through FIG. 6. FIG. 1 illustrates a front view diagram of the embodiment of a current invention. FIG. 2 through FIG. 5 illustrate a cross-section diagram cut along lines (2—2,3—3,4—4 and 5—5) as illustrated in FIG. 1.

As shown in FIG. 1, the door open/close operating device 11 includes a bracket 30, a base plate 31 as a base forming a housing and an ECU case 32 forming a housing. An attaching hole 30*a* is provided at the bracket 30, which is formed relative to the frat form of the base plate 31 (a lid wall portion 31*a*). The base plate 31 is set in the attaching hole 30*a* and fixed by screws with the ECU case 32 to the bracket 30. The door open/close operating device 11 is assembled to the side door 10 with the bracket 30.

Figure 2:
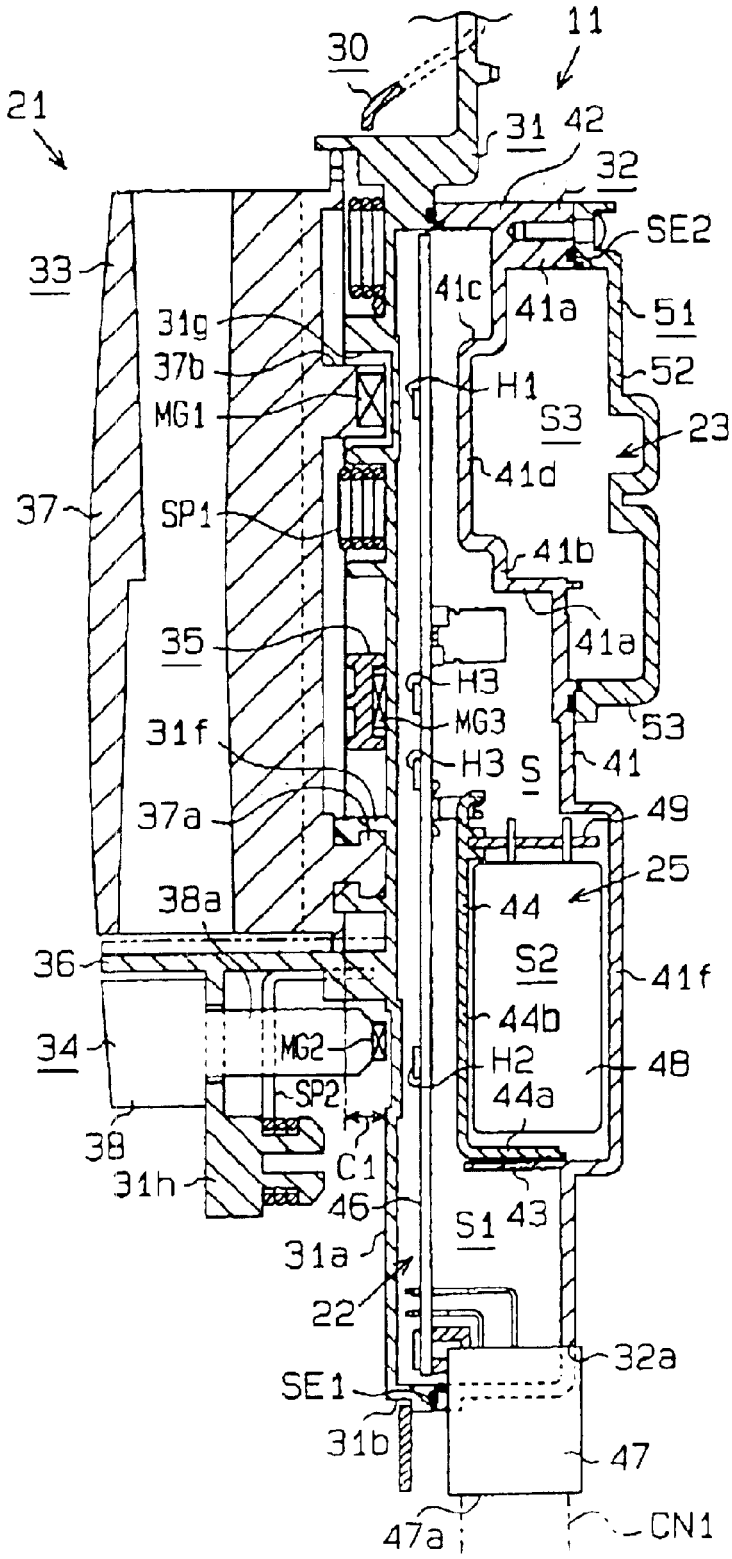
FIG. 2 illustrates a cross-section diagram along a line 2—2 as illustrated in FIG. 1.

The base plate 31 is an approximately box type comprising the lid wall portion 31*a* and a side wall portion 31*b* which extends continuously from outer peripheral surface of the lid wall portion 31*a* and to project in the rightward direction in FIG. 2. As shown in FIG. 1, the base plate 31 (the lid wall portion 31*a*) includes a first wall portion 31*c* extending vertically in FIG. 1, a second wall portion 31*d* extending to rightward at the upper portion of the first wall portion 31*c* and a third wall portion 31*e* extending to rightward at the lower portion of the first wall portion 31*c*.

The operating switch portion 21 is supported on the opposite side of the housing portion. In other word, the operating switch portion 21 includes an open switch 33, a lock/unlock switch 34, a child protector switch 35 and an indicator 36, and these switches (33–36) are supported by the base plate 31. The open switch 33 controls lock/unlock operation of the front lock 12, the rear lock 13 and the fully/half open stopper 14. The lock/unlock switch 34 is for allowing or not allowing the lock/unlock operation by the open switch 33 for the front lock 12, the rear lock 13 and the fully/half open stopper 14. The child protector switch 35 is for not allowing the lock/unlock operation of the front lock 12, the rear lock 13 and the fully/half open stopper 14 even if the open switch 33 and the lock/unlock switch 34 is operated from inside of the vehicle.

The open switch 33 includes an operating lever 37 which is rotated by a driver. The operating lever 37 is provided at the upper portion of the base plate 31 (the first wall portion 31*c*) in FIG. 1 and FIG. 2. A rotation axis 37*a* projecting in the rightward direction in FIG. 2 is provided at the lower portion of the operating lever 37 in FIG. 2. A diameter of the edge of the rotation axis 37*a* is increased for engaging with the base plate 31. On the other hand, an axis housing portion 31*f* is formed relative to the rotation axis 37*a*, which is projecting in leftward direction in FIG. 2. The axis housing portion 31*f* includes an axis portion which is an elastic transformable type, an approximately cylinder form and radially recessed at predetermined angles. The axis housing portion 31*f* also includes a detent pawl projecting radially in the inward direction at the edge of the axis portion. The rotation axis 37*a* is inserted into and engaged with the axis housing portion 31*f* and connected to the base plate 31 by a hinge, so that the operating lever 37 is supported rotatably. The rotation axis 37*a* is connected to the base plate 31 by a hinge without any through-hole. A predetermined clearance C1 is provided between the edges of the operating lever 37 and the base plate 31 except the engaging portion (the rotation axis 37*a* and the axis housing portion 31*f*.)

Figure 6:
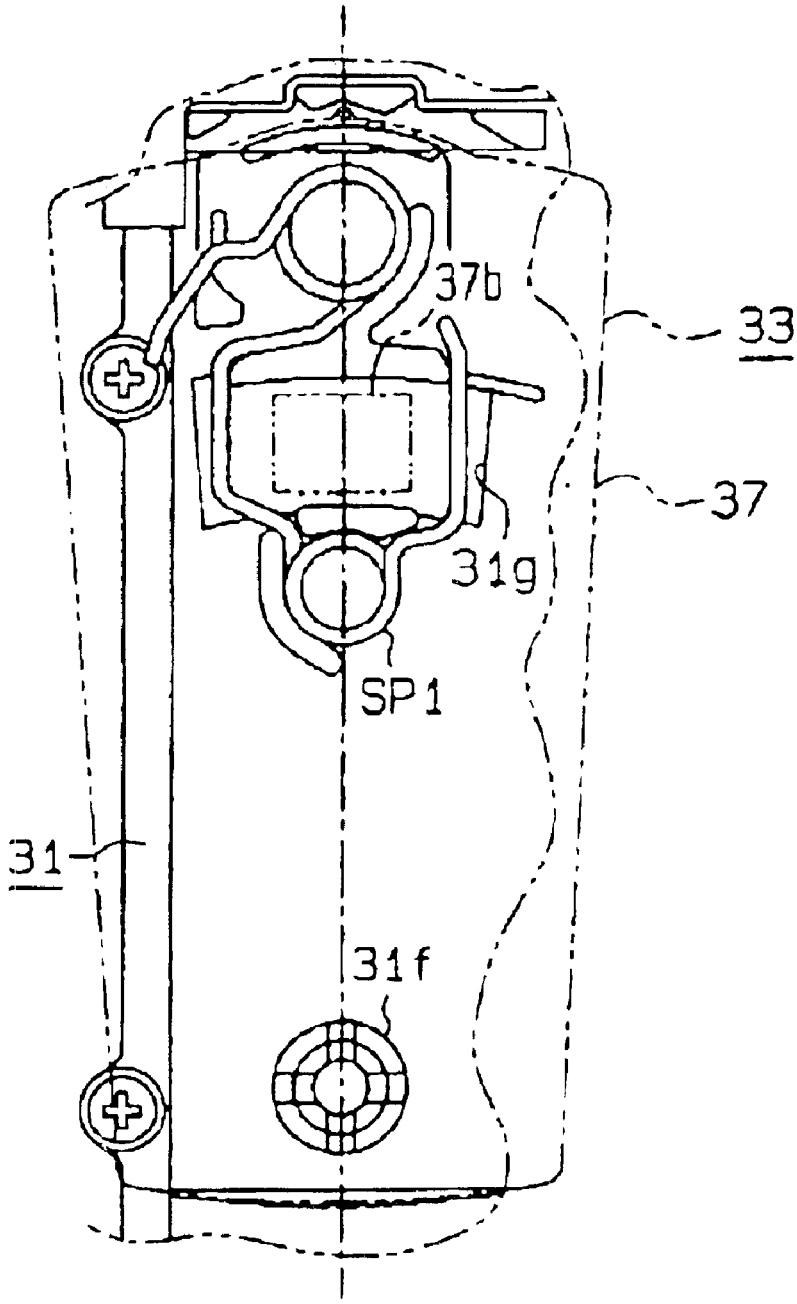
FIG. 6 illustrates a front view diagram which indicates a part of a base plate.

The upper portion (in FIG. 2) of the operating lever 37 is provided with a projecting portion 37*b* facing to the base plate 31 and projecting in the rightward direction in FIG. 2. A magnet MG1 is embedded in the projecting portion 37*b* for detecting an operation (movement) of the operating lever 37. On the other hand, as shown in FIG. 6, a concave portion 31*g* is formed at the base plate 31 relative to the projecting portion 37*b*.

A twisted spring SP1 is provided at the base plate 31 to restore the operating lever 37 to the predetermined original position after its operation. Each edge of the twisted spring SP1 is engaged with the operating lever 37 with biasing force on the right side and the left side in FIG. 6 relative to a center line which is connecting the axis housing portion 31*f* and the concave portion 31*g* (the projecting portion 37*b*). Thus, the operating lever 37 restores to its original position by the biasing force of the twisted spring SP1 after the operating lever 37 rotates in the rightward or leftward direction in FIG. 1.

The lock/unlock switch 34 includes an operating button 38 for slide operation by the driver. The operating button 38 is provided below the operating lever 37 keeping a predetermined distance between the operating button 38 and the operating lever 37. Specifically, an axis portion 38*a* is provided at the operating button 38 projecting in the rightward direction in FIG. 2. On the other hand, a supporting portion 31*h* is provided at the base plate 31 with a margin in the direction of a movement of the operating button 38. The axis portion 38*a* is inserted into the supporting portion 31*h*. As the axis portion 38*a* inserted through the supporting portion 31*h*, the operating button 38 is supported slidably in the horizontal direction in FIG. 1. A twisted spring SP2 is provided at the base plate 31 to restore the operating button 38 to the predetermined original position after its operation. The twisted spring SP2 is engaged with the axis portion 38*a* with biasing force in the horizontal direction in FIG. 4. Thus, the operating lever 37 restores to the original position by the biasing force of the twisted spring SP2 after the operating button 38 rotates in the rightward or leftward direction in FIG. 1.

A magnet MG2 is embedded on the right edge surface (in FIG. 2) of the axis portion 38*a* for detecting the operation (movement) of the operating button 38. On the other hand, a concave portion 31*i* is formed at the base plate 31 relative to the axis portion 38*a*.

Figure 3:
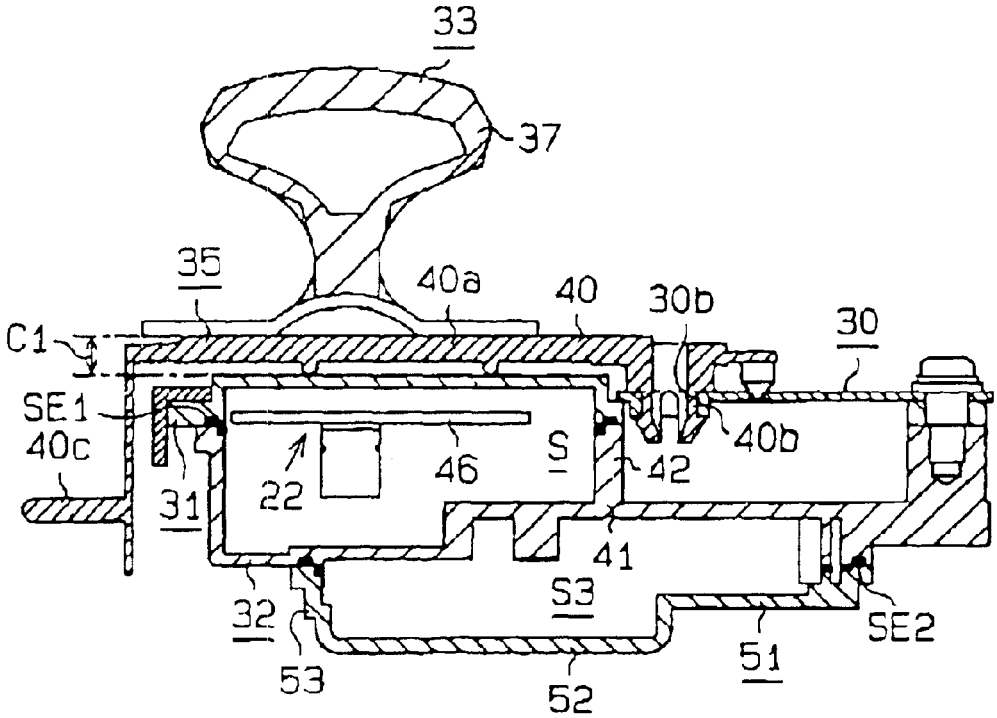
FIG. 3 illustrates a cross-section diagram along a line 3—3 as illustrated in FIG. 1.

The child protector switch 35 includes an operating lever 40 rotated by the driver. The operating lever 40 is supported rotatably within the clearance C1 which is provided between the base plate 31 and the operating lever 37. As shown in FIG. 3, the operating lever 40 includes an extending portion 40*a*, a rotation axis 40*b* and a lever portion 40*c*.

The extending portion 40*a* extends in the horizontal direction in FIG. 3, and the rotation axis 40*b* projects in the downward direction in FIG. 3, and the lever portion 40*c* bends from the extending portion 40*a* in the downward direction in FIG. 3.

The rotation axis 40*b* is a snap fit form including an axis portion and a detent pawl. The axis portion is elastic transformable approximately cylinder form and radially recessed at predetermined angles. The detent pawl projects in an inward radial direction at the edge of the axis portion.

The operating lever 40 connects with the base plate 31 via the rotation axis 40*b* which is inserted into and engaged with a bearing hole 30*b* formed on the bracket 30. In this way, the operating lever 40 is supported rotatably. The operating lever 40 (the extending portion 40*a*) slides between the base plate 31 and the operating lever 37. ON or OFF condition of the child protector switch 35 is defined by the position of the operating lever 40 for its operation.

As shown in FIG. 2, a magnet MG3 is embedded in the operating lever 40 for detecting the movement of the operating lever 40. The indicator 36 is provided between the open switch 33 and the lock/unlock switch 34 and informs whether or not the unlock operation by the lock/unlock switch 34 is allowed. The indicator 36 is turned on or off according to the ON or OFF condition of the lock/unlock switch 34 which allows to unlock the locks.

The ECU case 32 is an approximately box type including a base wall portion 41 and a side wall portion 42. The side wall portion 42 extends continuously from the base wall portion 41 and projects in the leftward direction in FIG. 2 along the side wall portion 31*b* of the base plate 31. Thus, the base plate 31 and the ECU case 32 form a closed housing space S for electric components.

A seal member SE1 is sandwiched for waterproofing between an edge surface of the side wall portion 31*b* and an edge surface of the side wall portion 42, in other word, the seal member SE1 is sandwiched for waterproofing between matching faces of the base plate 31 and the ECU case 32.

The upper potion of the base wall portion 41 in FIG. 2 of the ECU case 32 bulges in the leftward direction in FIG. 2 with a height of a stepped wall portion 41*a*, and a first wall portion 41*b* is formed thereat. The center portion of the first wall portion 41*b* bulges in the leftward direction in FIG. 2 with a height of a stepped wall portion 41*c*, and a second wall portion 41*d* is formed thereat. Thus the upper portion of the base wall portion 41 bulges in the leftward direction in FIG. 2 with heights of the stepped wall portion 41*a* and the stepped wall portion 41*c*, as a result, the housing space is extended. The first wall portion 41*b* extends continuously to the side wall portion 42 at upper portion in FIG. 2.

On the other hand, the lower portion (in FIG. 2) of the base wall portion 41 of the ECU case 32 bulges in the rightward direction in FIG. 2 with a height of a stepped wall portion 41*e*, and a third wall portion 41*f* is formed thereat. The third wall portion 41*f* bulges in the rightward direction in FIG. 2 with a height of a stepped wall portion 41*g*, and a forth wall portion 41*h* is formed thereat.

Thus, the lower portion of the base wall portion 41 bulges in the rightward direction in FIG. 2 with a height of the stepped wall portion 41*e* and the stepped wall portion 41*g*, as a result, the space (housing space S) is extended. The stepped wall portion 41*e* and the stepped wall portion 41*g* extend continuously to the side wall portion 42 of the ECU case 32.

A board type supporting wall portion, 43 extends from the lower portion of the third wall portion 41*f* in FIG. 2 and projecting in the leftward direction in FIG. 2. The supporting wall portion 43 extends continuously to the side wall portion 42 in the rightward direction in FIG. 4. Thus, the supporting wall portion 43 and a part of the side wall portion 42 comprise a flat surface.

The flat surface comprising the supporting wall portion 43 and a part of the side wall portion 42 is provided with a capacitor case 44 as a separating member. The capacitor case 44 includes a supporting wall portion 44*a* extending toward the top end of the side wall portion 42, and a separating wall portion 44*b* bent from the supporting wall portion 44*a* and extends along the third wall portion 41*f* and the forth wall portion 41*h*.

The capacitor case 44 bulges in the leftward direction in FIG. 2 with a height of a stepped wall portion 44*c*, and a first separating wall portion 44*e* is formed thereat. The first separating wall portion 44*e* bulges in the leftward direction in FIG. 2 with a height of a stepped wall portion 44*d*, and a second separating wall portion 44*f* is formed thereat. A stepped wall portion 44*g* is formed at the right portion of the separating wall portion 44*b* in FIG. 4 extending toward the lower portion of the side wall portion 42 in the FIG. 4 in a stepped pattern.

A predetermined clearance is provided between the first separating wall portion 44*e* and the base plate 31, the second separating wall portion 44*f* is provided approximately contacting with the base plate 31. The housing space S formed by the base plate 31 and the ECU case 32 is divided into a first housing space S1 and a second housing space S2.

As shown in FIG. 2, an ECU board 46 of the ECU 22 mounting various types of electric components is housed in the first housing space S1. The form of the ECU board 46 approximately follows the form of the lid wall portion 31*a* of the base plate 31 (the first wall portion 31*c* and the second wall portion 31*d*).

Two Hall elements H1 are mounted to the ECU board 46 as detect portions. Two Hall elements H1 are provided relative to the projecting portion 37*b* (magnet MG1) at which the operating lever 37 is at an original position. These two Hall elements H1 are juxtaposed in the upright direction relative to FIG. 2. Thus, when the projecting portion 37*b* (magnet MG1) is moved according to the operation of the operating lever 37, a magnetic flux near the Hall elements H1 changes. The Hall elements H1 outputs power voltage according to the magnetic flux. Thus, the EUC 22 detects the operation of the operating lever 37 based on the voltage of the Hall elements H1.

Two Hall elements H2 are mounted to the ECU board 46 as detect portions provided relative to a magnet MG2 at which the operating button 38 is at an original position. These two Hall elements H2 are juxtaposed in the upright direction relative to FIG. 2. Thus, when the magnet MG2 is moved according to the operation of the operating lever 38, a magnetic flux near the Hall elements H2 changes. The Hall elements H2 output power voltage according to the magnetic flux. Thus, the EUC 22 detects the operation of the operating button 38 based on the voltage of the Hall elements H2.

The Hall elements H3 are provided relative to the position of the operating lever 40 which is rotated according to the ON or OFF condition of the child protector switch 35. Two Hall elements H3 detect a magnetic flux from a magnet MG3 on the ECU board 46. Thus, when the magnet MG3 is moved according to the operation of the operating lever 40, a magnetic flux near the Hall elements H3 changes. Then, the Hall elements H3 outputs power voltage respectively according to the magnetic flux. Thus, the EUC 22 detects ON or OFF condition of the child protector switch 35 based on the voltage of the Hall elements H2.

An opening portion 32*a* is formed at the lower portion of the ECU case 32 in FIG. 2, and a waterproof connector 47 as a connector is provided thereat. A jack 47*a* of the waterproof connector 47 is provided projecting outwardly from the ECU case 32. A gap between a wall on the external side of the waterproof connector 47 and the jack 47*a* is sealed for waterproofing.

Thus, the ECU board 46 (ECU 22) is housed in the housing space S (the first housing space S1) in approximately sealed condition except an external portion of the connecting portion (the jack 47*a*) of the waterproof connector 47. The waterproof connector 47 may be formed integrally with the ECU case 32. The waterproof connector 47 is fixed to the ECU board 46 and electrically connected to a wire on the ECU board 46.

The waterproof connector 47 connects to the harness on the vehicle side through the connector CN1 on the vehicle side which is inset into the waterproof connector 47. Various types of information of the vehicle are input to the ECU 22 (the ECU board 46) through the waterproof connector 47, and a power is supplied to the ECU 22 (the ECU board 46) from the vehicle's battery as a main power (not shown).

A vertical direction of the door open/close operating device 11 assembled to the slide door 10 approximately corresponds to a vertical direction in FIG. 1 and FIG. 2. Thus, the waterproof connector 47 is provided at lower in the vertical direction. The jack 47*a* of the waterproof connector 47 where the connector CN1 on vehicle side is inserted in is facing in the vertical downward direction, however, the jack 47*a* may face in any downward direction. At this point, the jack 47*a* of the waterproof connector 47 is preferable to be facing backward of the vehicle when the jack 47*a* is assembled to the vehicle.

Figure 4:
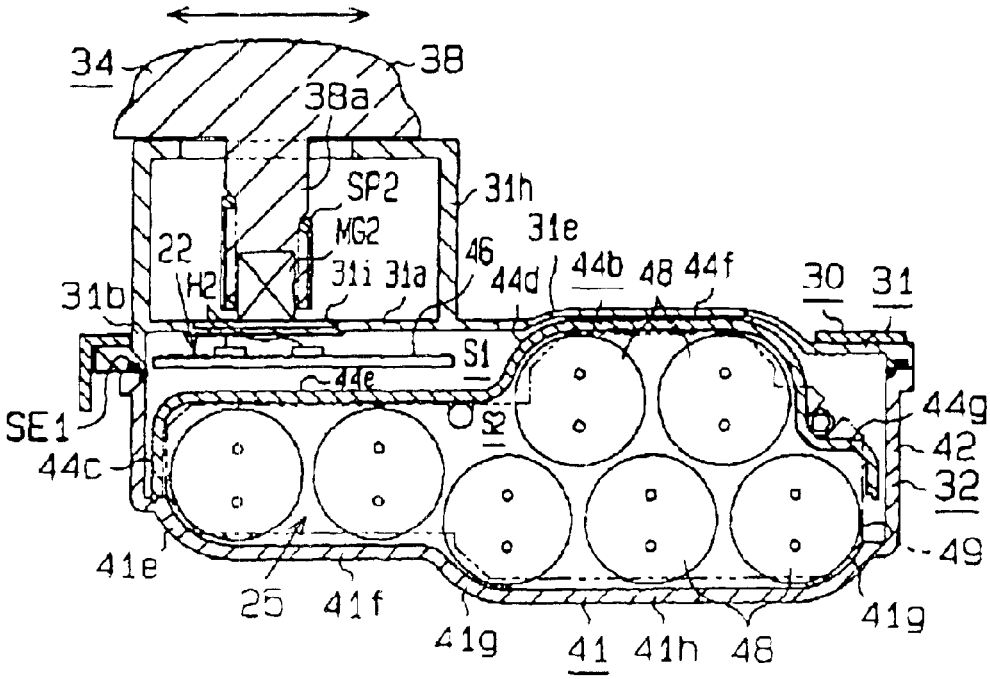
FIG. 4 illustrates a cross-section diagram along a line 4—4 as illustrated in FIG. 1.

As also shown in FIG. 4, the auxiliary power source 25 is comprised of plural capacitors 48 (7 in this embodiment) which are housed in the second housing space S2. Specifically, two capacitors 48 are housed in a line in a space between the third wall portion 41*f* of the base wall portion 41 and the first separating wall portion 44*e* of the separating wall portion 44*b* (capacitor case 44), and five capacitors 48 are housed alternately in two lines in a space between the forth wall portion 41*h* and the second separating wall portion 44*f*. Thus, the capacitors 48 (auxiliary power source 25) are housed in the second housing space S2, which is separated form the first housing space S1 for the ECU board 46 by the capacitor case 44.

The capacitors 48 (auxiliary power source 25) are housed in the housing space S (the second housing space S2) in approximately sealed condition except an external portion of the connecting portion of the waterproof connector 47. The horizontal direction of the door open/close operating device 11 assembled to the slide door 10 approximately corresponds to a horizontal direction in FIG. 1. Thus, the most of the capacitors 48 are provided at rear of the vertical direction.

A capacitor board 49 which is fixed to the capacitor case 44 covers the upper portion of the second housing space S2. Terminals of each capacitor 48 is in bare condition relative to the capacitor board 49 and connected electrically to a power supply terminal of the waterproof connector 47 through a bus bar (not shown) wired to the capacitor board 49 and the wire of the ECU board 46.

The capacitors 48 are electric double layer capacitor type. The capacitors 48 are charged by a power supplied from the vehicle's battery and supply a power secondarily to the ECU 22 and the release actuator 23 by discharging its power.

An actuator housing 51 is fixed to the upper portion of the base wall portion 41 of the ECU case 32 on opposite side of the base plate 31, which forms a housing portion bulging in the rightward direction in FIG. 2. Specifically, an extending wall portion 41*i* is formed at the base wall portion 41, which extends in the rightward direction in FIG. 5. A stepped wall portion 41*j* extends continuously to the extending wall portion 41*i* through the stepped wall portion 41*a*. The base wall portion 41 bulges in the leftward direction in FIG. 2 with heights of the stepped wall portion 41*a* and the stepped wall portion 41*j*.

On the other hand, the actuator housing 51 is an approximately box type including a base wall portion 52 and a side wall portion 53. The side wall portion 53 extends from the base wall portion 52 and projects in the leftward direction in FIG. 2 along a peripheral edge portion of the base wall portion 52 approximately surrounding the stepped wall portion 41*a* and the stepped wall portion 41*j*.

Thus, the each edge surface of the stepped wall portion 41*a*, the stepped wall portion 41*j* and the side wall portion 53 is contacting each other, and the ECU case 32 and the actuator housing 51 forms the third housing space S3 which is an approximately sealed housing space for machine parts. The third housing space S3 extends to the outer of the housing space S along the stepped wall portion 41*j* of the extending wall portion 41*i*. A seal member SE2 is sandwiched for waterproofing between edge surfaces of the stepped wall portion 41*a*, the stepped wall portion 41*j* and the side wall portion 53, in other word, the seal member SE2 is sandwiched for waterproofing between matching faces of the ECU case 32 and the actuator housing.

Figure 5:
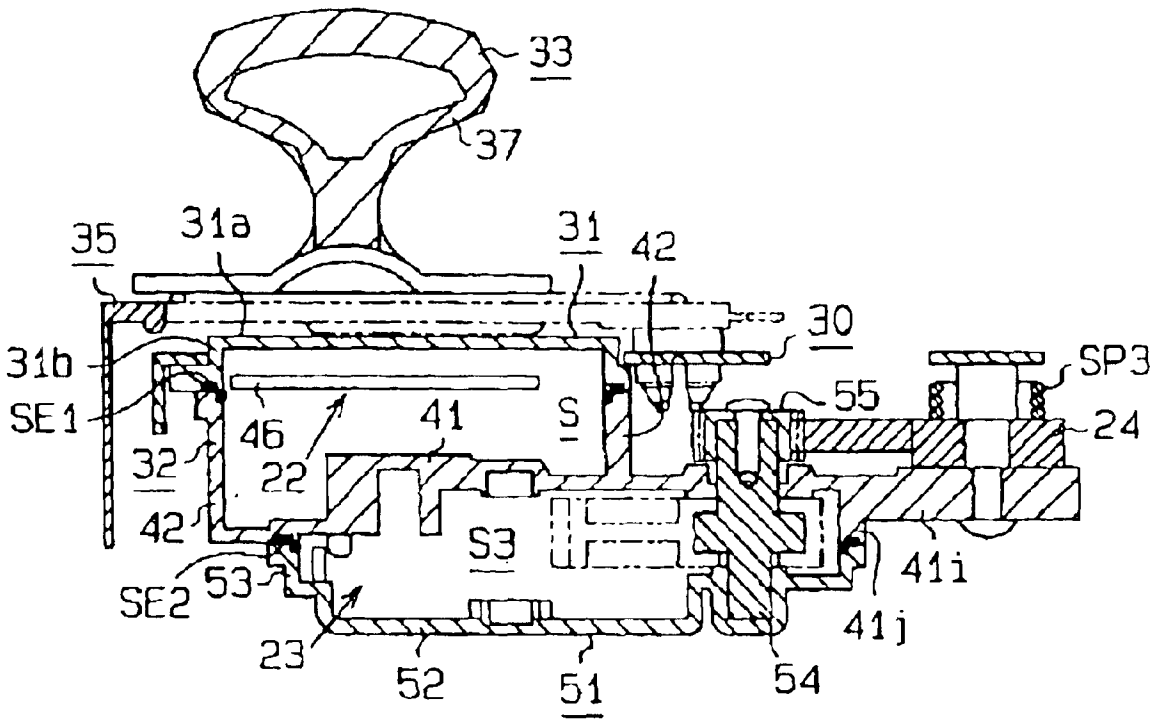
FIG. 5 illustrates a cross-section diagram along a line 5—5 as illustrated in FIG. 1.

As also shown in FIG. 5, the release actuator 23 is housed in the third housing space S3. The output axis of the release actuator 23 is rotatably supported by the ECU case 32 and the actuator housing 51 (the base wall portion 52) near the stepped wall portion 41*j*. A lower end portion of the output axis 54 extends completely through the base wall portion 41 at the outside of the side wall portion 42 (and the side wall portion 31*b*) of the housing space S.

An output gear 55 is fixed by screw to a top end portion of the output axis 54 protruding to the outside of the base wall portion 41 (the third housing space S3). The output gear 55 is rotatably driven by a drive force of the release actuator 23 through the output axis 54. Thus, the release actuator 23 is housed in the third housing space S3 in approximately sealed condition except the edge portion of the output axis 54 protruding to the outside of the third housing space S3 for transmitting the drive force.

The remote control lever 24 is rotatably supported by the extending wall portion 41*i* of the base wall portion 41 at the outside of the side wall portion 53 (and the stepped wall portion 41*j*) which forms the third housing space S3. As also shown in FIG. 1, the remote control lever 24 includes an input lever portion 24*a* and an output lever portion 24*b*. The input lever portion 24*a* extends toward the output gear 55 and engages with the output gear 55. The output lever portion 24*b* extends toward the outside of the base wall portion 42 (the extending wall portion 41*i*). An upper end portion of the output lever portion 24*b* is connected to the front lock 12, the rear lock 13 and the fully/half open stopper 14 through the connecting cables 26, 27, and 28.

Thus, when the output gear 55 is rotatably driven by a drive force of the release actuator 23, the drive force is transmitted to the remote control lever through the input lever portion 24*a*. The output lever portion 24*b* of the remote control lever 24 locks or unlocks the front lock 12, the rear lock 13 and the fully/half open stopper 14 transmitting the drive force to each locks and the stopper through the connecting cables 26, 27, and 28. A twisted spring SP3 is provided at the remote control lever 24 to restore the remote control lever 24 to a predetermined original position after its operation. Thus, the remote control lever 24 is restored to the predetermined original position by a biasing force generated after the remote control lever 24 is driven for lock/unlock operation of the front lock 12, the rear lock 13 and the fully/half open stopper 14.

As described above, the invention has following effects.

(1) According to the embodiments of the invention, members related to the door open/close operation are integrally provided. Specifically, the operating switch portion 21 (the open switch 33, the lock/unlock switch 34, the child protector switch 35 and the indicator 36), the ECU 22, the release actuator 23, the remote control lever 24 and the auxiliary power source 25 are integrally provided. Thus, the door open/close operating device 11 becomes small as a whole. As a result, when the door open/close operating device 11 is assembled to the slide door 10, assembling flexibility is enhanced, and the assembling man-hour is reduced. The enhancement of assembling flexibility enables the slide door 10 to be assembled to the most suitable position.

(2) According to the embodiments of the invention, the housing portion is formed on the base plate 31 supporting the open switch 33, the lock/unlock switch 34, the child protector switch 35 and the indicator 36. As a result, the number of the members and the assembling man-hour are reduced comparing to another device which has a housing portion with a special cover.

(3) According to the embodiments of the invention, the housing space S for the ECU 22 and the auxiliary power source 25 and the third housing space S3 for the release actuator 23 are provided separately so as to, for example, prevent the ECU 22 or the auxiliary power source 25 from bad effects adhesion of a grease which come from the release actuator 23. The ECU 22 and the auxiliary power source 25 are provided collectively in the housing space, and these members are electrically and directory connected each other. As a result, the number of the harness and a cost and a mass of the harness are also reduced.

(4) According to the embodiments of the invention, the ECU board 46 of the ECU 22 and a harness on the vehicle's side are collectively connected by the water proof connector 47. Signal wires of the Hall elements H1, H2 and H3 (signal wires of the switches 33, 34 and 35) and the power wire of the auxiliary power source 25 are collectively connected to the ECU board 46 of the ECU 22. As a result, the type the terminals becomes requisite minimum, for example, an input terminal for vehicle's information or a power supplying terminal for the vehicle's battery etc. The number of the harness is also reduced because terminals are connected collectively to the waterproof connector 47. As a result, a cost and a mass are reduced, and the assembling operation to the vehicle becomes simple. In addition, an assembling performance is improved, and the assembling man-hour is reduced. As a result, an assembling cost is reduced.

(5) According to the embodiments of the invention, the ECU 22 (the ECU board 46) and the auxiliary power source 25 are divided by the capacitor case 44. If battery electrolyte leaks from the capacitors 48 (auxiliary power source 25), the battery electrolyte spreads only within the second housing space S2. In addition, a second accident, for example, a defect of the abutting electric members (e.g. ECU 22) by an adhesion of the battery electrolyte, can be prevented.

The second housing space S2 for the auxiliary power source 25 (capacitors 48) is formed using a certain portion of the ECU case 32 (the third wall portion 41*f* and the forth wall portion 41*h*). Thus, the width of the second housing space S2 which is in the vehicle's width direction when the door open/close operating device 11 is assembled to the slide door 10 (a distance between the base wall portion 41 of the ECU case 32 and the capacitor case 44) is reduced and becomes thinner than the width of another device, for example, a device housing the auxiliary power source 25 respectively. Thus, the door open/close operating device 11 becomes small in the vehicle's width direction.

(6) According to the embodiments of the invention, the remote control lever 24 is provided integrally with the extending wall portion 41*i* of the ECU case 32 housing the release actuator 23. In other word, the remote control lever 24 is supported rotatably by the ECU case 32. Thus, a rotation of the remote control lever 24 is controlled by a common member (the ECU case 32) keeping the distance between a pivot point of the output gear 55 of the release actuator 23 and a pivot point of the remote control lever 24 in a certain distance. Generally, when door is unlocked on door open/close operation, a drive force from the release actuator is needed to overcome the reaction force of a large door.

However, when the force from the release actuator becomes stronger, a stroke loss is generated due to a rotatable supporting structure of the remote control lever. Transmitting mechanism portion of the remote control lever and the release actuator are need to be designed with a stroke design allowing for the difference of the distance between the pivot point of the output gear 55 of the release actuator 23 and the pivot point of the remote control lever 24. In this invention, the remote control is designed to be rotatably supported by the ECU case, so that the difference of the distance between the pivot point of the output gear 55 of the release actuator 23 and the pivot point of the remote control lever 24 becomes minimum, and the stroke loss becomes minimum when an stroke from the release actuator 23 is transmitted.

(7) According to the embodiments of the invention, the open switch 33, the lock/unlock switch 34 and the child protector switch 35 are the noncontact switch. The Hall elements H1, H2 and H3 are provided on the ECU board 46 of the ECU 22 fixed to the housing space S (the first housing space S1) facing the base plate 31 (the lid wall portion 31*a*). The Hall elements H1, H2 and H3 face the magnets across the base plate 31.

Thus, there is no need to use a harness for input operation of the switches 33, 34, and 35. The structure of the base plate 31 (lid wall portion 31*a*) becomes simple because there is no need to open holes thereat. If a waterproof structure is applied to the housing portion, the waterproofing is implemented with a simple design change.

(8) According to the embodiments of the invention, the operating lever 40 (the extending portion 40*a*) of the child protector switch 35 is provided and supported within the clearance C1 which is provided between the facing edge surfaces of the operating lever 37 and the base plate 31. The operating lever 40 is provided at the unused space, so that the door open/close operating device 11 becomes small as a whole.

Providing the operating lever 40 between the facing edge surfaces of the operating lever 37 and the base plate 31, the operating lever 40 ensures its required performance with a simple structure, and there is no need to use a special structure to prevent a pivotally movement of the operating lever 40 on its operation and no need to enhance the stiffness of the operating lever 40. In other word, the pivotally movement or a flexure on the operation of the operating lever 40 is prevented, and a displacement between the magnet MG3 and the hole elements H3 relative to the magnet MG3 can be prevented. Thus, even if the operating lever 40 (and its peripheral device) becomes larger, flexibility is not reduced on a layout of the components, and the enlargement of the door open/close operating device 11 as a whole are prevented because the required performance of the operating lever 40 is ensured with the simple structure. Specifically, the pivotally movement of the operating lever 40 is prevented preferably in spite of its relatively long structure from the center hinge (rotation axis 40*b*) to the lever portion 40*c*.

(9) According to the embodiments of the invention, the auxiliary power source 25 is provided at the lower portion of the base plate 31 and the ECU case 32 when the door open/close operating device 11 is assembled to the vehicle (slide door 10). Thus, if a battery electrolyte leaks from the auxiliary power source 25 (capacitors 48) due to its defects (a secular change or a defect in manufacturing), components which suffer from an adhesion of the battery electrolyte are in below the auxiliary power source 25. In addition, a second accident, for example, a defect of the ECU 22 (the ECU board 46) by an adhesion of the battery electrolyte, can be reduced.

If the auxiliary power source 25, which is tend to be enlarged, is provided at the upper portion of the vehicle (the upper portion of the base plate 31 and the ECU case 32), flexibility of the component alignment is reduced because the auxiliary power source 25 overlaps with the thick components, for example, a member for reinforcing the strength of the slide door 10 in vehicle's width direction. Thus, flexibility of the component alignment is enhanced providing the auxiliary power source 25 at lower portion of the device.

(10) According to the embodiments of the invention, the jack 47*a* of the waterproof connector 47 is facing down in vertical direction. Thus, a penetration of water drops which fall down the ECU case 32 into the jack 47*a* is prevented. The jack 47*a* of the waterproof connector 47 may face from in the vertically downward direction to the horizontally backward direction of the vehicle.

Generally, when the vehicle sinks, the front portion of the vehicle begins to sink at first due to a heavy load, for example, a load of the engine provided at the front of the vehicle. If the jack faces in the backward direction of the vehicle, a penetration of water into the jack is delayed.

(11) According to the embodiments of the invention, it is enabled to lock/unlock the front lock 12, the rear lock 13 and the fully/half open stopper 14 only by the operation of the remote control lever 24. Thus, this system can reduce the number of the members for the lock/unlock operation and improve flexibility for assembling the door open/close operating device 11 to the slide door 10 comparing to another system which operates these lock/unlock operations by driving output members provided respectively for each lock.

(12) According to the embodiments of the invention, the auxiliary power source 25 is comprised of the plural capacitors 48. Generally, the auxiliary power source 25 often tends to be enlarged because a large operating current is needed to ensure the operation of the release actuator 23. In the current invention, plural small capacitors are used instead of one large capacitor or one large battery, as a result, flexibility of an alignment of the capacitors is enhanced, and the components becomes smaller.

(13) According to the embodiments of the invention, the seal member SE1 is sandwiched between the edge surface of the side wall portion 31*b* and the edge surface of the side wall portion 42. Thus, the ECU 22 (the ECU board 46) and the auxiliary power source 25 are waterproofed as a whole inside the housing space S.

(14) According to the embodiments of the invention, the seal member SE2 is sandwiched between the edge surface of the ECU case 32 and the edge surface of the actuator housing 51. Thus, the release actuator is waterproofed inside the third housing space S3.

(15) According to the embodiments of the invention, the auxiliary power source 25 is provided, and even if the power supply from the vehicle side is stopped, the auxiliary power source 25 backups the power and prevents to fail the door open/close operation.

(16) According to the embodiments of the invention, the open switch (operating lever 37), the lock/unlock switch 34 (operating button 38) and the child protector switch 35 (operating lever 40) are not connected mechanically to the lock/unlock the front lock 12, the rear lock 13 and the fully/half open stopper 14. Thus, operating forces for the switches 33, 34 and 35 are controlled easily without a consideration of a mechanical load, and drivers can operate the door open/close operation without an excessive operating force.

The embodiments of the invention are not limited to the embodiments as described above and allowed to change as follows.

Figure 9:
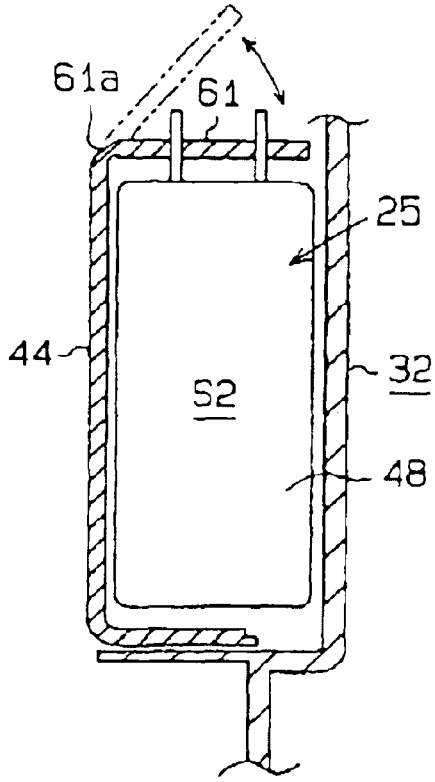
FIG. 9 illustrates a pattern diagram of another example of the current invention.
Figure 10:
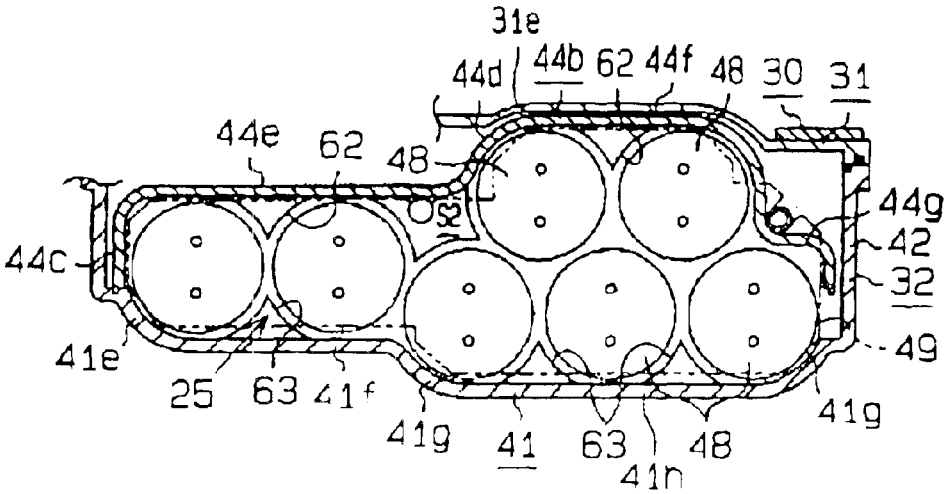
FIG. 10 illustrates a pattern diagram of another example of the current invention.

According to the embodiments of the invention, the capacitor case 44 and the capacitor board 49 are provided independently. This may be applied to a capacitor board 61 formed integrally with the capacitor case 44 as shown in FIG. 9. In other word, the capacitor board 61 is formed integrally with the capacitor case 44 through a hinge portion 61*a* which is relatively thin for a hinge movement of the capacitor board 61. The upper portion of the second housing space S2 in FIG. 10 is covered/uncovered by the capacitor board 61 which makes pivotally movement via the hinge portion 61*a*. Thus the number of the members or the man-hour for assembling are reduced.

In addition, the integral structure of the capacitor case 44 and the capacitor board 61 allows the bus bar to be in stable position, and a position gap between the ECU 22 (the ECU board 46) and the bus bar, which is generated by a difference of the assembling to the housing space S, is reduced.

According to the embodiments of the invention, guide walls 62 may be provided at the capacitor case 44 according to the position of the capacitors 48 in the second housing space S2 to settle the position of the capacitors 48 (auxiliary power source 25) as shown in FIG. 10. The guide walls 62 are inwardly projecting form and provided inside the second housing space S2 along the outer peripheral surface of the capacitors 48.

On the other hand, guide walls 63 may be provided at the base wall portion 41 (the third wall portion 41*f* and the forth wall portion 41*h*) according to the position of the capacitors 48 in the second housing space S2 to settle the position of the capacitors 48 (auxiliary power source 25). The guide walls 63 are inwardly projecting form and provided inside the second housing space S2 along the outer peripheral surface of the capacitors 48.

Thus, the guide walls 62 and the guide walls 63 settle the position of the auxiliary power source 25 (capacitors 48), and the auxiliary power source 25 is smoothly housed and assembled inside the second housing space S2. The guide walls 62 also prevent a joggle from the capacitors 48 in the second housing space S2.

When the capacitor board 61 is provided integrally with the capacitor case 44 (FIG. 9), the position difference of the capacitors 48 is reduced by connecting the bus bar of the capacitor board 61 to the each terminal of the capacitors 48. The efficiency of the connecting operation is improved.

The guide walls 63 may be formed integrally with the capacitor case 44. In this case, the plural capacitors 48 (auxiliary power source 25) are fixed in advance to the capacitor case 44 which is formed integrally with the guide walls, and the capacitor case 44 with the capacitors 48 is assembled to the housing space S as one component, thus, an assembling performance has been improved.

According to the embodiments of the invention, the auxiliary power source 25 is comprised of the capacitors 48, however, the capacitor can be replaced by a chargable/dischargable battery. In this case, if the battery leaks, an adhesion of the battery electrolyte on the ECU 22 can be prevented because the ECU 22 and the capacitors 48 are separated by the capacitor case 44.

According to the embodiments of the invention, the waterproof connector 47 connecting to the harness on the vehicle is formed integrally with the base plate 31 and the ECU case 32. In this case, the number of the components and the assembling man-hour has been reduced comparing to another device with another type of connector.

According to the embodiments of the invention, various types of information of lock/unlock condition of the front lock 12, the rear lock 13 and the fully/half open stopper 14 may be output from the RCU22 to the vehicle through the waterproof connector 47.

Having now fully described the invention, it will be apparent to one of ordinary skill in the art that many changes and modifications can be made without departing from the spirit or scope of the invention as set forth herein.

What is claimed is:

1. A door open or close operating device comprising:

an operating switch;

a control device which detects an operation of the operating switch;

an actuator which is driven by the control device, an output member which is driven by the actuator and transmits a drive force from the actuator to a door open/close member, and an auxiliary power source which subsidiarily supplies a power to the control device and the actuator, wherein the operating switch, the control device, the actuator, the output member and the auxiliary power source are integrally formed.

2. A door open or close operating device according to claim 1, wherein a base which supports the operating switch forms a housing portion.

3. A door open or close operating device according to claim 2, wherein a connector is formed integrally with the housing portion for connecting a harness located at a vehicle side.

4. A door open or close operating device according to claim 2, wherein the operating switch includes a plurality of noncontact switches, and a plurality of detecting portions each detecting operation of a respective one of the operating switches, each detecting portion being assembled to a board of the control device fixed inside the housing portion and facing the respective operating switch across the base.

5. A door open or close operating device according to claim 2, wherein a housing space for electrical components including the control device and the auxiliary power source and a housing space for machine components comprising the actuator are separately provided in the housing portion.

6. A door open or close operating device according to claim 5, wherein the output member is integrally formed at the housing portion.

7. A door open or close operating device according to claim 6, wherein a connector is formed integrally with the housing portion for connecting a harness located at a vehicle side.

8. A door open or close operating device according to claim 5, wherein a connector is formed integrally with the housing portion for connecting a harness located at a vehicle side.

9. A door open or close operating device according to claim 5, wherein the operating switch includes a plurality of noncontact switches, and a plurality of detecting portions detecting operation of a respective one of the operating switches, each detecting portion being assembled to a board of the control device fixed inside the housing portion and facing the respective operating switch across the base.

10. A door open or close operating device according to claim 6, wherein the operating switch includes a plurality of noncontact switches, and a plurality of detecting portions detecting operation of a respective one of the operating switches, each detecting portion being assembled to a board of the control device fixed inside the housing portion and facing the respective operating switch across the base.

11. A door or close operating device according to claim 5, wherein a separating member is provided for separating the control device from the auxiliary power source in the housing space for the electric components.

12. A door open or close operating device according to claim 11, wherein the output member is integrally formed at the housing portion.

13. A door open or close operating device according to claim 12, wherein the operating switch includes a plurality of noncontact switches, and a plurality of detecting portions detecting operation of a respective one of the operating switches, each detecting portion being assembled to a board of the control device fixed inside the housing portion and facing the respective operating switch across the base.

14. A door open or close operating device according to claim 11, wherein a connector is formed integrally with the housing portion for connecting a harness located at a vehicle side.

15. A door open or close operating device according to claim 11, wherein the operating switch includes a plurality of noncontact switches, and a plurality of detecting portions detecting operation of a respective one of the operating switches, each detecting portion being assembled to a board of the control device fixed inside the housing portion and facing the respective operating switch across the base.

* * * * *